United States Patent [19]

Broyles et al.

[11] 4,183,570

[45] Jan. 15, 1980

[54] RETRACTABLE TRASH SPEAR

[76] Inventors: Marshall W. Broyles, 201 Lincoln Dr.; Charles D. Schrader, 119 E. Monroe St., both of Alexandria, Ind. 46001

[21] Appl. No.: 929,164

[22] Filed: Jul. 28, 1978

[51] Int. Cl.[2] ..... B01B 1/00

[52] U.S. Cl. ..... 294/61

[58] Field of Search ..... 294/61, 19 R, 50, 50.5, 294/50.6, 110 A

[56] References Cited

U.S. PATENT DOCUMENTS

| | | | |
|---|---|---|---|
| 2,642,306 | 6/1953 | Beeley | 294/61 |
| 2,695,188 | 11/1954 | Klausman et al. | 294/61 |

*Primary Examiner*—James B. Marbert

*Attorney, Agent, or Firm*—Gust, Irish, Jeffers & Rickert

[57] ABSTRACT

A retractable trash spear device comprises an elongated tubular handle member having opposite ends with an elongated rod element therein having a pointed end and being axially movable between an extended position with the pointed end projecting from one end of the handle member and a fully retracted position with the pointed end completely within the handle member. The handle member has an elongated slot formed therein adjacent its other end, and a manual actuating element is adjustably attached to the rod element and extends out of the slot for selectively moving the rod element between its retracted and extended positions. A coil spring in the handle member surrounding the rod element biases the rod element towards its retracted position. The lower end of the slot in the handle member has a right angle extension thereon for holding the actuating element thereby to hold the rod element in its extended position.

3 Claims, 5 Drawing Figures

RETRACTABLE TRASH SPEAR

BACKGROUND OF THE INVENTION

1. Field of the Invention

This invention relates generally to trash spear devices.

2. Description of the Prior Art

Spear devices have been used for many years for retrieving litter from the ground and commonly comprise a stick having a pointed object on one end thereof, such as a nail, for impelling trash thereon. Such prior trash spear devices are hazardous by reason of the pointed end and further, the trash impelled thereon must be manually removed therefrom. It is therefore desirable to provide a trash retrieving device of the spear type which eliminates much of the hazard of prior spear devices and the requirement of manually removing trash therefrom.

SUMMARY OF THE INVENTION

A retractable trash spear device comprises an elongated tubular handle member having opposite ends. An elongated rod element is disposed in said handle member and has a pointed end, the rod element being axially movable between an extended position with the pointed end projecting from one end of the handle member, and a fully retracted position with the pointed end substantially completely within the handle member. The handle member has an elongated slot formed therein adjacent its other end, and a manual actuating element is attached to the rod element at a point spaced from the pointed end and extends out of the slot for selectively moving the rod element between its retracted and extended positions. Spring means is provided in the handle member for biasing the rod element toward the retracted position, and means is provided for selectively holding the rod element in its extended position. In one embodiment of the invention, an enlarged, flat member is secured to the one end of the handle member so that the device can also be used for compacting trash in a receptacle.

It is accordingly an object of the invention to provide an improved retractable trash spear device.

Another object of the invention is to provide an improved retractable trash spear device additionally usable as a trash compactor.

The above-mentioned and other features and objects of this invention and the manner of attaining them will become more apparent and the invention itself will be best understood by reference to the following description of an embodiment of the invention taken in conjunction with the accompanying drawings.

Figure 1:
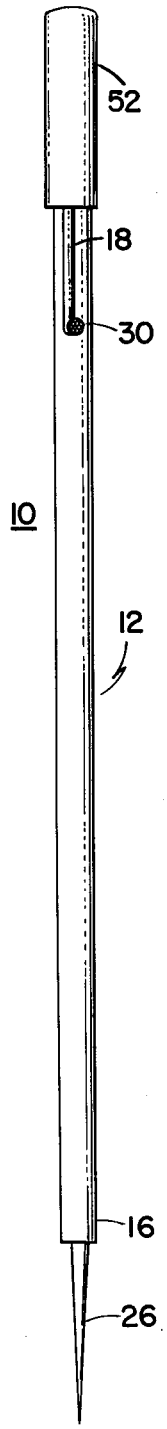
FIG. 1 is a side elevational view of the improved retractable trash spear device of the invention in its extended position.

FIG. *2a* is an enlarged, side, cross-sectional view showing the upper part of the device of FIG. 1 in the retracted position;

FIG. *2b* is a side, cross-sectional view showing the lower portion of the device of FIG. *2a;*

Figure 3:
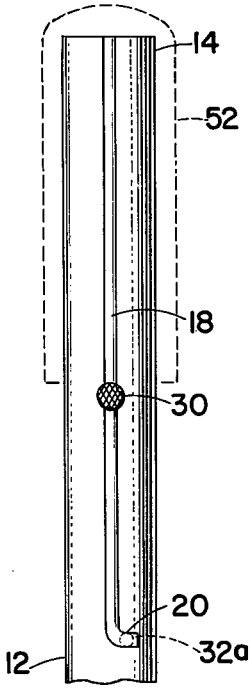
Figure 4:
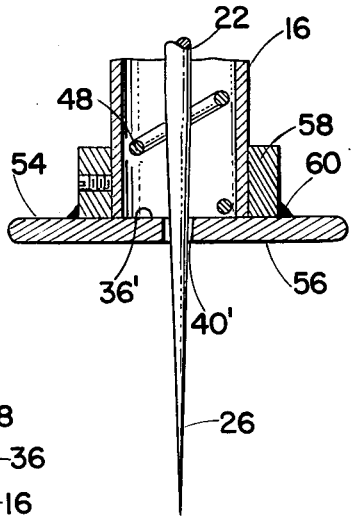

FIG. 3 is a fragmentary, side elevational view of the upper portion of the device of FIG. 1 with the hand grip member removed; and FIG. 4 is a fragmentary, side, cross-sectional view showing an embodiment of the invention additionally usable for compacting trash.

DESCRIPTION OF THE PREFERRED EMBODIMENT

Figure 2A:
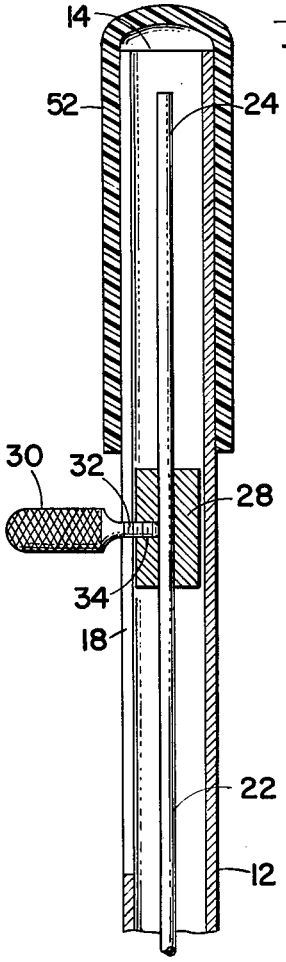
Figure 2B:
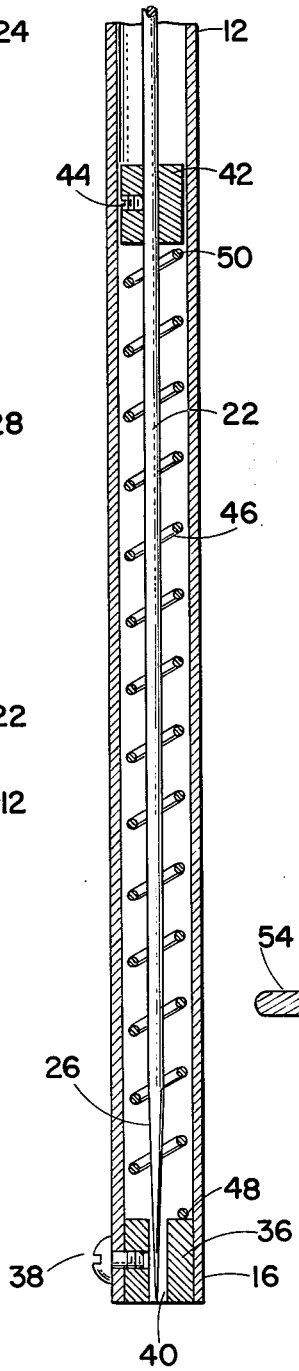

Referring now to FIGS. 1–3 of the drawings, the improved retractable trash spear device of the invention, generally indicated at 10, comprises an elongated tubular handle member 12 having open top end 14 and open bottom end 16. Elongated, axially extending slot 18 is formed in handle member 12 extending downwardly from top end 14 and having right angle extension 20 formed in its bottom end for a purpose to be hereinafter described.

Elongated rod element 22 is provided disposed in handle member 12 and having top end 24 and sharp pointed bottom end 26. Rod element 22 is selectively movable between an extended position with pointed end 26 projecting from bottom end 16 of handle member 12, as shown in FIG. 1, and a fully retracted position completely within handle member 12, as shown in FIGS. *2a* and *2b*.

In order to move rod element 22 between its extended and retracted positions, ferrule member 28 is slideably mounted on rod element 22 at a point adjustably spaced from bottom end 26. Manual actuating member 30 has its inner end 32 threaded in opening 34 in ferrule member 28 to engage rod element 22, inner end 32 of actuating member 30 extending outwardly through slot 18. The threaded engagement of inner end 32 of actuating member 30 in opening 34 in ferrule member 28 permits axial adjustment of ferrule member 28 on rod element 22, thereby selectively to determine the desired extend of the projection of pointed end 26 from end 16 of handle member 12 in the extended position, and to accommodate periodic sharpening of end 26 which reduces the overall length of rod 22. Movement of actuating member 30 to the right, as viewed in FIGS. 1 and 3, in its lower position at the bottom end of slot 18 so that inner end 32 enters right angle extension 20, as shown in dashed lines at 32*a* in FIG. 3, serves to retain rod element 22 in its extended position.

Spring seat member 38 is retained in end 16 of handle member 12 by suitable threaded fastener 38 and has central opening 40 therein through which pointed end 26 of rod element 22 extends in the extended position. Spring seat member 42 is slideably mounted on rod element 22 in handle member 12 and is adjustably secured to rod element 22 by suitable set screws 44. Coil spring 46 surrounds rod element 22 in handle member 12 and has its opposite end 48, 50 respectively engaging spring seat members 36, 42, thereby biasing rod element 22 to its retracted position, as best seen in FIG. *2b*. Handle grip member 52 formed of suitable resilient material is positioned on top end 14 of handle member 12 and exposes the operating section of slot 18.

It will now be seen that the hazard of prior trash retrieval spear devices is greatly reduced with the improved retractable spear device of the invention since pointed end 26 of rod element 22 need only be extended during the operation of retrieving trash from the ground and may at other times be retracted. Further, it will be seen that trash may be removed from pointed end 26 and deposited in a suitable receptacle by merely retracting rod element 22 and thus, the user need not touch the trash or debris on pointed end 26.

Referring now to FIG. 4 in which like elements are indicated by like reference numerals and similar elements by primed reference numerals, an enlarged trash compacting member 54 is provided having a substantially flat bottom surface 56. Compacting member 54 is secured to a collar element 58, as by welding at 60. Bottom end 16 of handle member 12 is inserted in collar member 58 so as to engage inner portion 36' of compactor member 54 which thus serves as a seat for bottom end 48 of spring 46. Collar member 58 and compactor member 54 are secured to bottom end 16 of handle member 12 by suitable set screw 62. Inner portion 36' of compactor member 54 has center opening 40' therein through which pointed end 26 of rod element 28 extends in the extended position.

It will now be seen that the embodiment of FIG. 4, with the rod element 22 retracted as above described, can additionally be used for compacting trash deposited in a receptacle, such as a plastic trash bag.

While there have been described above the principles of this invention in connection with specific apparatus, it is to be clearly understood that this description is made only by way of example and not as a limitation to the scope of the invention.

What is claimed is:

1. A retractable trash spear device comprising: an elongated tubular handle member having opposite ends; an elongated rod element in said handle member and having a pointed end and an opposite end, said rod element being axially movable between an extended position with said pointed end projecting from one end of said handle member and a fully retracted position with said pointed end substantially completely within said handle member; said handle member having an elongated slot formed therein adjacent said other end; a manual actuating element attached to said rod element adjacent at a point spaced from said pointed end thereof and extending out of said slot for selectively moving said rod element between said retracted and said extended positions; spring means in said handle member for biasing said rod element toward said retracted position; means for selectively holding said rod element in said extended position; said slot extending to said other end of said handle member and having an end axially spaced therefrom, said holding means comprising a substantially right-angle extension of said slot at said end thereof, and further comprising a handle grip member on said other end of said handle member, said grip member having an end spaced from said slot end thereby exposing a section thereof, said actuating element extending through said exposed section of said slot; a ferrule element slidably mounted on said rod element adjacent said opposite end thereof and having a threaded opening therethrough communicating with said rod element, said actuating element having an inner end threadedly secured in said threaded opening and engaging said rod element thereby adjustably attached said actuating element to said rod element selectively to determine the extent of projection of said pointed end of said rod element in said extended position.

2. The device of claim 1 further comprising a first spring seat member secured in said handle member at said one end thereof and having an opening therein through which said pointed end of said rod element extends in said extended position, a second spring seat member in said handle member adjustably secured to said rod element and axially spaced from said first spring seat member, said spring means comprising a coil spring surrounding said rod element and having opposite ends respectively engaging said seat members.

3. The device of claim 1 further comprising a trash compacting member secured to said one end of said handle member and having a first portion extending across the same, said compacting member having a second portion extending radially outwardly from said one end of said handle member and having a substantially flat bottom surface, said first portion of said compacting member having an opening therethrough communicating with the interior of said handle member through which said pointed end of said rod element extends in said extended position thereof, and a spring seat member in said handle member adjustably secured to said rod element and axially spaced from said first portion of said compacting member, said spring means comprising a coil spring surrounding said rod element and having opposite ends respectively engaging said spring seat member and said first portion of said compacting member.

* * * * *